United States Patent [19]

Nitta

[11] 4,088,087

[45] May 9, 1978

[54] REMOTE CONTROL APPARATUS MARINE VESSELS HAVING DUAL PROPELLER SHAFTS

[75] Inventor: Akifumi Nitta, Kobe, Japan

[73] Assignee: The Nippon Air Brake Co., Ltd., Kobe, Japan

[21] Appl. No.: 751,543

[22] Filed: Dec. 16, 1976

[30] Foreign Application Priority Data

Jan. 6, 1976 Japan ..... 51-1317

[51] Int. Cl.[2] ..... B63H 25/22

[52] U.S. Cl. ..... 114/150; 60/392; 60/420; 91/388; 114/144 R; 115/18 R

[58] Field of Search ..... 60/388, 392, 407, 420; 91/388; 114/144, 150, 157; 115/35–38, 18 R, 18 E; 180/6.48

[56] References Cited

U.S. PATENT DOCUMENTS

| | | | |
|---|---|---|---|
| 3,234,856 | 2/1966 | Martin | 114/150 X |
| 3,805,727 | 4/1974 | Seto | 114/150 |
| 3,976,023 | 8/1976 | Noguchi et al. | 114/144 E |

*Primary Examiner*—Stephen G. Kunin

*Attorney, Agent, or Firm*—R. S. Visk; R. W. McIntire, Jr.

[57] ABSTRACT

Fluid pressure operable remote control apparatus for a marine vessel equipped with a dual shaft and propeller propulsion system and fluid pressure operable operator controllers for coordinating operation respective valve devices and servo-positioners, whereby the desired operating disposition of the shafts and propellers, relative to each other, is effected for providing the desired speed and directional movement of the vessel.

4 Claims, 11 Drawing Figures

STEERING WHEEL
CONTROL LEVER 2
CONTROL LEVER 3
PLI
PRI
PL2
PR2
2
1
0
L
90°
0
90°
R
NEUTRAL
AS
0
AH
NEUTRAL
REVERSE FORWARD
NEUTRAL
REVERSE FORWARD
1
2
3
4
5
6
7
8
9
PLI
PRI
PL2
PR2
PL=PLI+PL2
PR=PRI+PR2
FLUID PRESSURE SUPPLY SOURCE
22

10
11
12
13
14
15
16
17
18
AS
AH
3
4
2
0
1
-0-
-1-
-2-
-3-
-4-

STEERING WHEEL
CONTROL LEVER 2
CONTROL LEVER 3
PLI
PL2
PR2
R
L
90°
NEUTRAL
AS
AH
REVERSE FORWARD
PL=PLI+PL2
PR=PR2+PLI
FLUID PRESSURE SUPPLY SOURCE
22

AS
AH
16
17

REMOTE CONTROL APPARATUS MARINE VESSELS HAVING DUAL PROPELLER SHAFTS

BACKGROUND OF THE INVENTION

In some types of marine vessels, such as tug boats, for example, a high degree of maneuverability is very desirable for performing the intended function such as maneuvering large ocean-going liners into berth at the docks. For this reason, some tug boats are equipped with variable speed dual propellers mounted on respective drive shafts which are angularly positionable relative to each other in a horizontal plane to thereby provide precise maneuverability of the vessel. Conventional remote control apparatus for dual-propeller systems, above noted, are normally of the electrical type, which have been found objectionable at times because electrical fluctuations and outside disturbances may cause distorted operational effects. Moreover, electrical apparatus is costly and is more difficult to repair in case of failure.

SUMMARY OF THE INVENTION

The object of the present invention, therefore, is to provide remote control apparatus of fluid pressure type for dual shaft and propeller systems of marine vessels for controlling direction and propulsion of the vessel.

Briefly, the invention comprises a pair of propeller shafts mounting respective propellers thereon, the speed of said propellers being adjustable as well as the angular disposition of the shafts relative to the axis of the vessel and to each other by common operator control means which, when operated to preselected positions by the operator, effect operation of a plurality of control valve devices to produce fluid pressure control signals accordingly. The control signals thus produced are transmitted to respective relay valves which, in turn, effect operation of servo-positioners which set the angular disposition of the propeller shafts according to the settings of the operator control means selected by the operator, thus establishing the speed and directional movement of the vessel.

BRIEF DESCRIPTION OF THE DRAWINGS

FIGS. 9, 10, and 11 show, schematically and graphically, a further modified embodiment of the control apparatus shown in FIG. 1 and the character of the fluid pressure control signals produced thereby.

DESCRIPTION AND OPERATION

Figures 1, 2, 3:
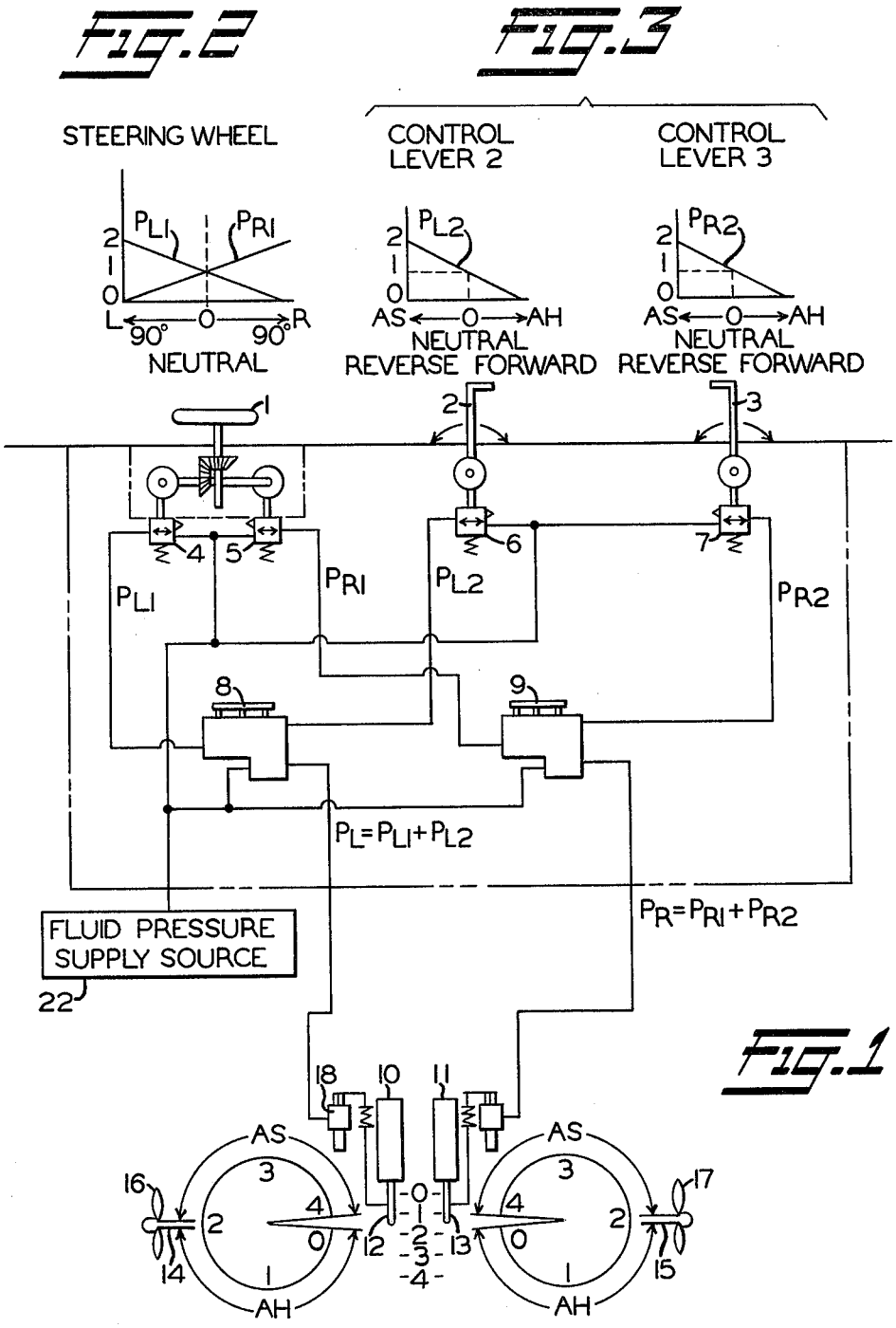
FIG. 1 is a schematic view of a preferred embodiment of a remote propulsion control apparatus for a marine vessel embodying the invention.
FIGS. 2 and 3 are graphic representations of the characters of fluid pressure control signals produced by various settings of the control apparatus.

In FIG. 1, the numeral 1 indicates the ship's steering wheel, 2 and 3 indicate forward and reverse control levers and 4, 5, 6, and 7 indicate respective fluid pressure control valve devices. In accordance with the angular displacement of steering wheel 1 and the amount of movement of the forward and reverse control levers 2 and 3, certain fluid pressure control signals $P_{L1}$, $P_{R1}$, $P_{L2}$ and $P_{R2}$, lying within a pressure range of 1 to 3 kg/cm$^2$, for example, are produced. For purposes of expediency of explanation of the invention, the pressure signals for the various propeller shaft directions will be denoted by the dimensionless numbers "0" to "2".

When steering wheel 1 is in a neutral position, the direction control pressure signals $P_{L1}$ and $P_{R1}$ are at "1", as shown graphically in FIG. 2. When steering wheel 1 is rotated 90° in a counterclockwise direction, for example (as graphically represented by leftwardly directed arrow L in FIG. 2), $P_{L1}$ becomes "2" and $P_{R1}$ becomes "0". When steering wheel 1 is rotated 90° in a clockwise direction, for example (as graphically represented by rightwardly directed arrow R in FIG. 2), from the neutral position, $P_{L1}$ becomes "0" and $P_{R1}$ becomes "2". Moreover, when, as shown in FIG. 3, the forward and reverse control lever 2 is in a neutral position, fluid pressure signal $P_{L2}$ is "1", whereas when in a reverse propulsion position (AS), $P_{L2}$ becomes "2" and when in a forward propulsion position (AH), it becomes "0". Furthermore, with respect to the forward and reverse control lever 3, in the same way, $P_{R2}$ is "1"in the neutral position and "2" in the reverse position, while it is "0" in the forward position.

Figure 5:
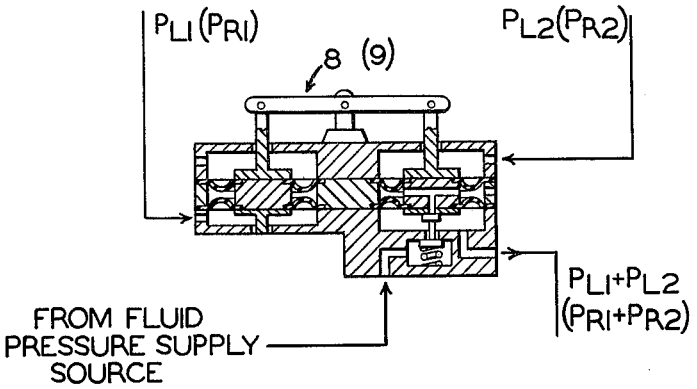
FIG. 5 is an elevational view, in section, of a relay valve device forming part of the control apparatus.

Numerals 8 and 9 indicate operating or relay valve devices. $P_{L1} + P_{L2}$ are accumulatively combined or added by means of valve 8, while $P_{R1} + P_{R2}$ are accumulatively combined or added by means of valve 9. Details of the internal structure of relay valve devices 8 and 9 (both being identical), said valve devices being of conventional type and, therefore, are shown in FIG. 5, from which it should be functioning in conventional manner, in response to the control signals transmitted thereto from valve devices 4, 5, 6, and 7, for supplying actuating pressure from a fluid pressure source at a pressure corresponding to the pressure signals.

Numerals 10 and 11 indicate servo-positioner units which, respectively, move output shafts 12 and 13 in proportion to the output fluid pressures $P_L = (P_{L1} + P_{L2})$ and $P_R = (P_{R1} + P_{R2})$ supplied thereto from the relay valves 8 and 9, respectively. The corresponding amount of movement is transmitted to shafts 14 and 15 of propellers 16 and 17, respectively, by means of suitable drive-follower devices. As a result, the propeller shafts 14 and 15 are rotated about the ends of respective connecting drive shafts (not shown and by which the propeller shafts are drivingly connected to the engine, not shown) as centers, to respective angular positions relative to each other and to the axis of the vessel or boat, which angular positions are strictly proportional to the aforesaid amount of movement.

Normally the control pressure signals or impulses applied to the servo-positioners 10 and 11 from relay valves 8 and 9, respectively, vary from 2 to 10 kg/cm$^2$. To simplify the description, the dimensionless numbers "0" to "4" are made to correspond to the various directions of propeller shafts 14 and 15. Output shafts 12 and 13 are moved to positions "0" to "4" in accordance with the pressures of the signal impulses, as shown in FIG. 1, and propeller shafts 14 and 15 are rotated to the positions from "0" to "4", shown in said FIG. 1 corresponding to the various displacements.

When the ship's steering wheel 1 and the forward and reverse levers 2 and 3 are all in respective neutral positions, pressure signals $P_{L1}$ and $P_{R1}$ are both at "1", control pressure signals $P_{L2}$ and $P_{R2}$ are both at "1", and accordingly the output pressure signals from the relay valves 8 and 9 are both at "2", while the propeller shafts 14 and 15 are in respective "0" positions, as shown in FIG. 1. When this is the case, the ship is stopped or in a state of rest.

When the steering wheel 1 is in its neutral position and the forward and reverse control levers 2 and 3 are in respective forward positions (AH position as shown in FIG. 3), control pressure signals $P_{L1}$ and $P_{R1}$ are both at "1" and control pressure signals $P_{L2}$ and $P_{R2}$ are both at "0", so that pressure signals $P_L$ and $P_R$ are both at "1", that is, $P_L = P_{L1} + P_{L2}$, or "1" + "0" = "1", and $P_R = P_{R1} + P_{R2}$, or "1" + "0" = "1". Thus, propeller shafts 14 and 15 both come to the "1" position (AH position as shown in FIG. 1) and the ship moves forward under full power.

Figure 4:
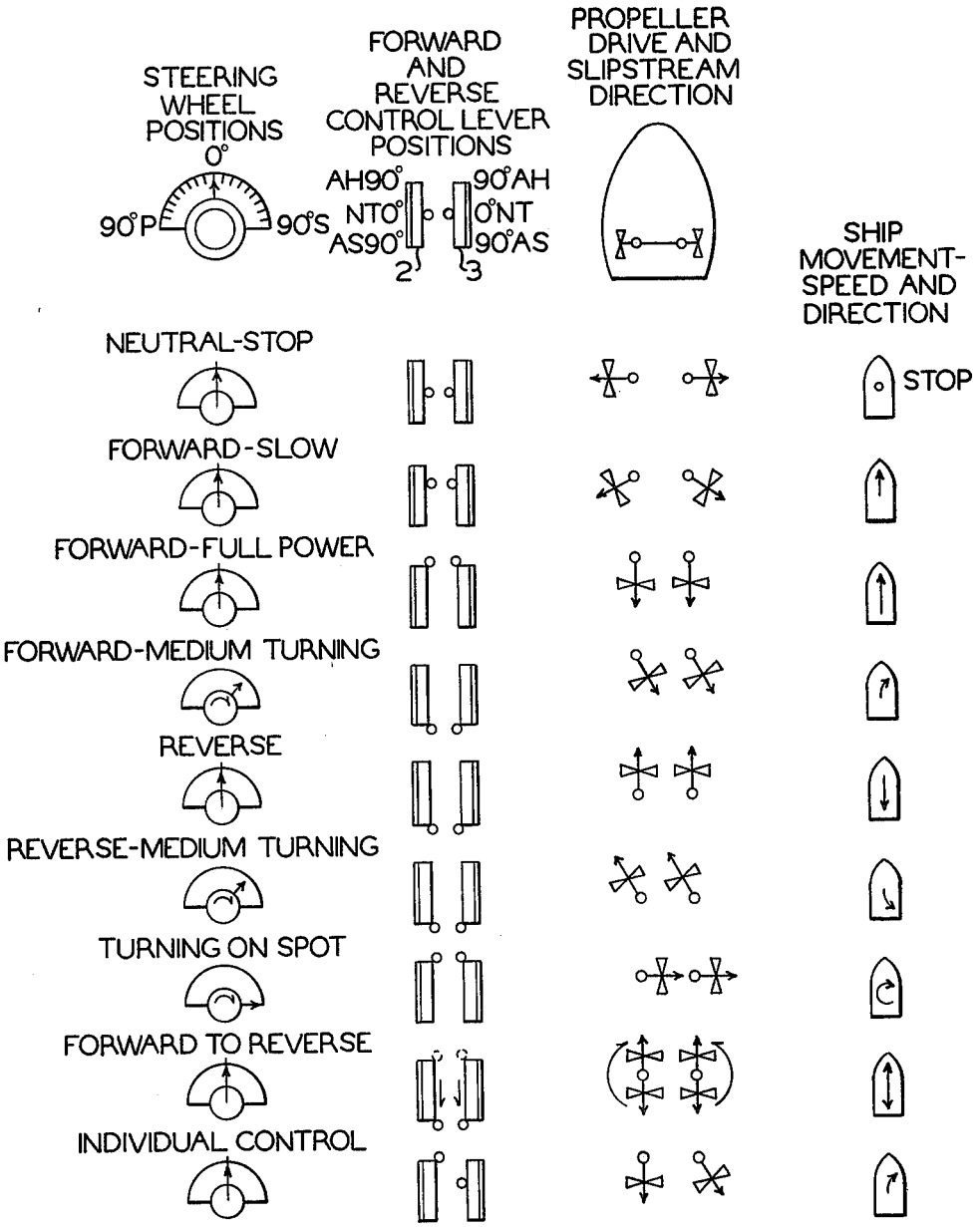
FIG. 4 is a chart, in symbolic form, showing the various settings of the control apparatus and the corresponding movement of the vessel produced thereby.

When both forward and reverse control levers 2 and 3 are in their respective forward positions, with steering wheel 1 turned 90° to the left (right), pressure signals $P_{L2}$ and $P_{R2}$ are both at "0", pressure signal $P_{L1}$ is at "2" ("0") and $P_{R1}$ is at "0" ("2"). Pressure signal $P_L$ becomes "2" ("0") and $P_R$ becomes "0" ("2"), so that propeller shaft 14 comes to position "2" ("0") while propeller shaft 15 comes to position "0" ("2"), and the ship is turned toward the left (right), giving rotation to the left (right) about a fixed position. Similar operations of the ship's movement may be performed as shown diagrammatically in FIG. 4.

Figure 6:
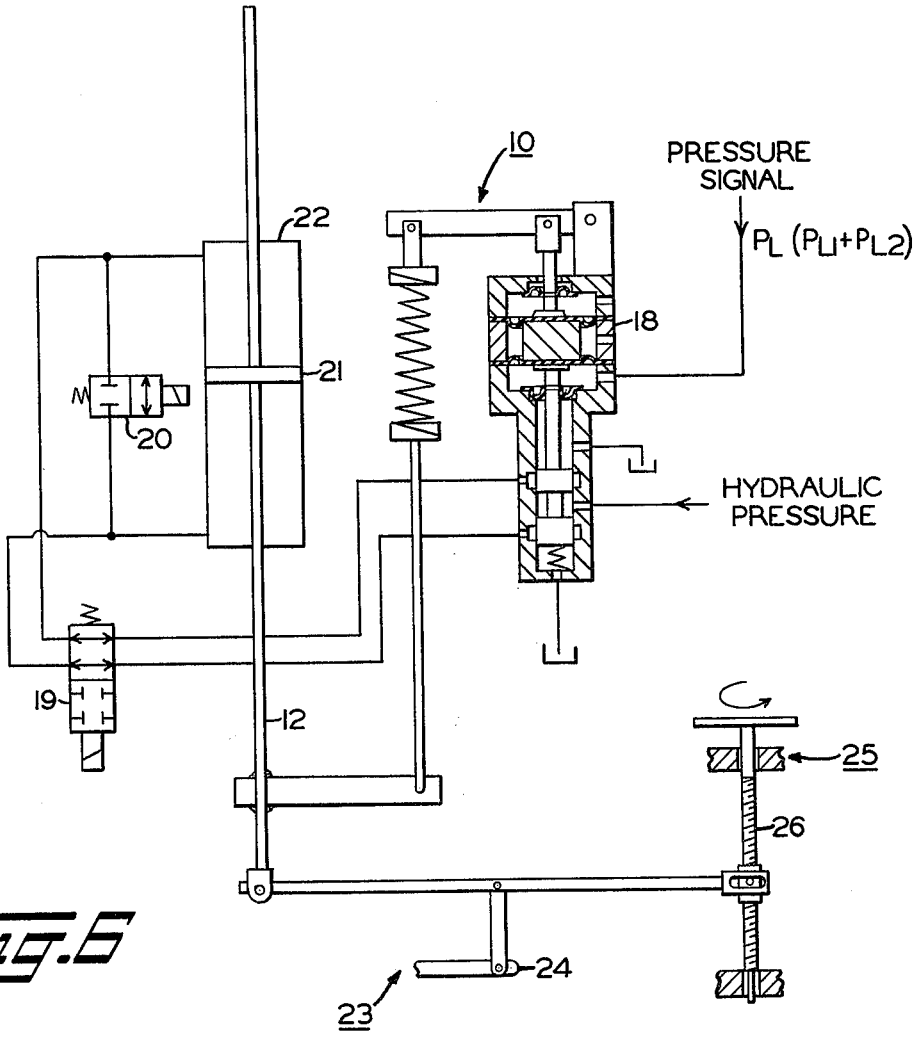
FIG. 6 is an elevational view, partly in section and partly in outline of a servo-positioner forming part of the control apparatus.

FIG. 6 shows the structure of the servo-positioner units 10 and 11. Since the units 10 and 11 are identical in structure, only unit 10, as an example, with particular reference to an input valve portion 18, which is the primary functional component, will be described. In the servo-positioner 10, air or hydraulic pressure may be used as the operating medium, but as is evident from the structure, as shown in FIG. 6, if hydraulic pressure is employed, an additional function is attainable.

In the event that supply pressure for effecting operation of servo-positioners 10 and 11 drops to such a value that control of said units cannot be effected thereby, the servo-positioner is maintained in position by operation of a solenoid valve 19, thus making it possible to prevent an unexpected change in direction of motion of the vessel. Also, there is provided for the eventuality of an abnormal operation, i.e., an operation taking place by manual means instead of by the remote control system, a solenoid valve 20 which is connected to two chambers located respectively on opposite sides of a piston 21 in a servo-cyclinder 22, whereby said servo-cylinder may be freely operated. With servo-cylinder 22, it is preferable to use a double piston rod form as shown in FIG. 6, where the effective pressure areas of the chambers on opposite sides of the piston 21 are equal. The numeral 23 indicates an example of a drive follower device for displacing the propeller shaft 14 in conformity with the displacement positions "0" to "4" of the output shaft 12 of servo-positioner 10. The drive follower device 23 comprises, for instance, a feedback mechanism which combines a hydraulic pressure motor and a variable-discharge hydraulic pressure pump, neither of which is shown. A pivoting lever 24 of the oil pump is operated by displacing the output shaft 12 of the servo-positioner, and the pivoting lever 24 is returned to a fixed position by means of a feedback mechanism 25 comprising a ball-screw 26.

Figures 7, 8:
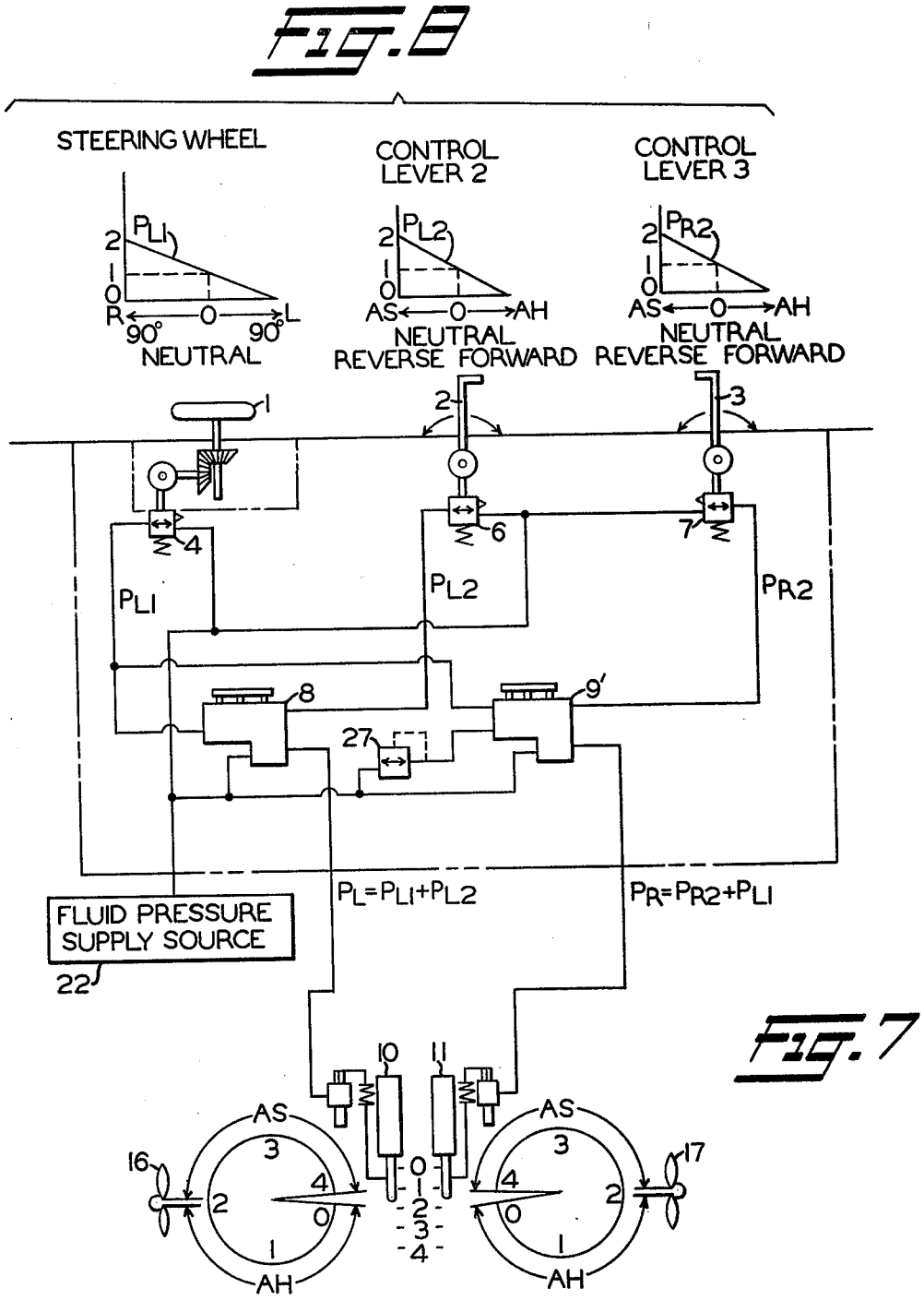
FIG. 7 is a schematic view of a modified embodiment of the control apparatus shown in FIG. 1.
FIG. 8 graphically shows the character of fluid pressure control signals produced by various settings of the control apparatus.

FIG. 7 shows another embodiment which is a modification of that shown in FIG. 1. In this embodiment one of the fluid pressure control valves 4 and 5 for the steering wheel 1 is omitted, such as valve device 5, for example, and the pressure signal $P_{L1}$ of pressure control valve 4 is fed to relay valve 9'as a differential pressure. The pressure signal from pressure supply source 22 is fed to the operator valve 9' as an accumulative pressure, via a pressure-reducing valve 27, reducing it to a pressure signal "2". Thus, the output pressure signal from relay valve 9' or $P_R$ = "2" + $P_{R2} - P_{L1}$. The rest of the structure and operation is the same as that shown in FIG. 1.

With respect to the embodiment shown in FIG. 7, FIG. 8 shows the relationship between the angle of rotation of the ship's steering wheel 1 and the pressure signal produced thereby, in which case it is only the pressure signal $P_{L1}$.

Figure 9:
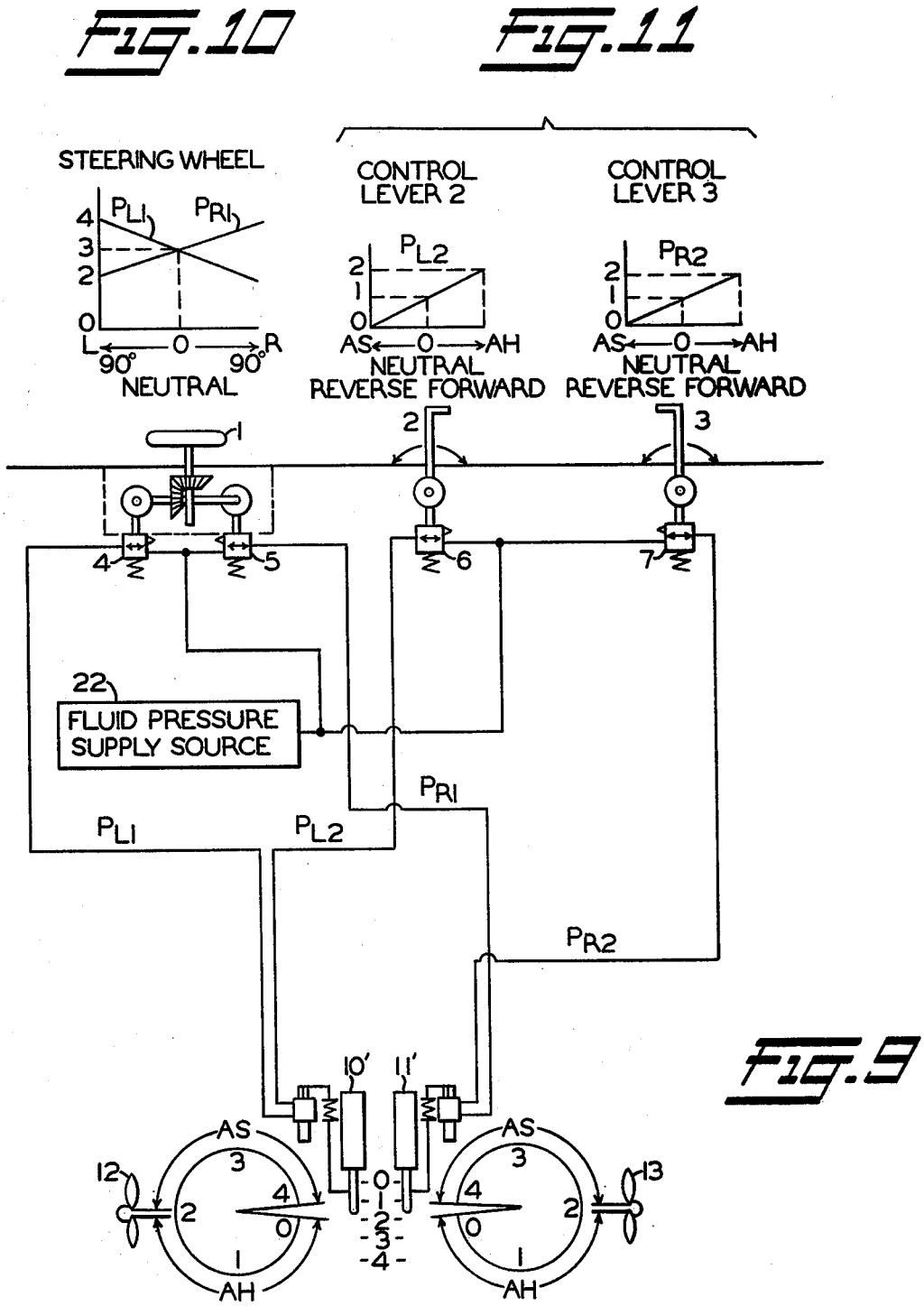

FIG. 9 shows another embodiment of the invention which is a further modification of that shown in FIG. 1. No special relay valve devices (such as devices 8 and 9 in FIG. 1) are used in this embodiment. Pressure signals $P_{R1} - P_{R2}$ and $P_{L1} - P_{L2}$ for input portions 28 and 29 of servo-positioner units 10' and 11' are transmitted directly from control valve devices 4, 5, 6, and 7 rather than through relay valve devices 8 and 9 which are omitted in this embodiment.

FIGS. 10 and 11, as related to the embodiment shown in FIG. 9, show the relationship between the operation of the ship's steering wheel 1 and the operation of the forward and reverse control levers 2 and 3 and the control pressure signals thus produced. It should be noted, however, that in this embodiment the pipework between the control station (Valves 4, 5, 6, and 7) and the servo-positioners 10' and 11' is doubled. In cases where the distance in question is short this is not a great disadvantage, while the fact that no relay valve devices such as 8 and 9 are needed, is a considerable advantage.

As mentioned hereinbefore, the present invention affords a remote control apparatus of a dual shaft propulsion system, thus offering, in place of conventional electrical apparatus, the advantages of simplified operating principles and construction, a high reliability, easy maintenance and reduced costs.

I claim:

1. Remote control apparatus for marine vessels having dual propeller shafts and propellers mounted thereon, said control apparatus comprising a first and a second propeller shaft, each being pivotally anchored at one end and each being angularly displaceable about said one end relative to each other and to the axis of the vessel for effecting a corresponding change in the direction of the vessel's propulsion and movement, a steering wheel for steering the vessel, control valve means operable responsively to rotation of said steering wheel for producing a first fluid pressure control signal for effecting rotation of said first and second propeller shafts in the same direction in accordance with the angle of rotation of the steering wheel, a pair of independently operable forward and reverse levers, a first control valve device for producing a second fluid pressure control signal at a pressure corresponding to the amount of movement of one of said forward and reverse control levers and related to the first propeller, a second control valve device for producing a third fluid pressure control signal at a pressure corresponding to the amount of movement of the other of said forward and reverse control levers and related to the second propeller, a first positioner device for angularly displacing said first propeller shaft, a second positioner device for angularly displacing said second propeller shaft, a first relay valve device connected to said control valve means and to said first control valve device and operable responsively to said second control signal produced thereby for causing operation of said first positioner device and consequent angular displacement of said first propeller shaft accordingly, and a second relay valve device connected to said control valve means and to said second control valve device and operable responsively to said third control signal produced thereby for causing operation of said second positioner device and consequent angular displacement of said second propeller shaft accordingly, the amount of said angular displacement of said first and second propeller shafts being in accordance with the pressure of said second and third control signals, respectively.

2. Remote control apparatus for marine vessels, as set forth in claim 1, wherein each of said positioner device comprises a hydraulically operable cylinder device connected to the respective propeller shaft and an input valve portion operable responsively to fluid pressure supplied thereto from the respective relay valve device for effecting said angular displacement of the respective propeller shaft.

3. Remote control apparatus for marine vessels, as set forth in claim 2, wherein each of said positioner devices comprises solenoid means operable at will for maintaining the respective positioner device in position in the event of failure of fluid pressure from the relay valve device.

4. Remote control apparatus for marine vessels, as set forth in claim 1, wherein said control valve means comprises at least one fluid pressure control valve device connected to both said first and second relay valve devices for providing a common fluid pressure control signal therefor.

* * * * *